US005887018A

United States Patent [19]

Bayazitoglu et al.

[11] Patent Number: 5,887,018

[45] Date of Patent: Mar. 23, 1999

[54] LONGITUDINAL ELECTROMAGNETIC LEVITATOR

[75] Inventors: Yildiz Bayazitoglu; Rod W. Shampine, both of Houston, Tex.

[73] Assignee: WM. Marsh Rice University, Houston, Tex.

[21] Appl. No.: 677,587

[22] Filed: Jul. 9, 1996

[51] Int. Cl.[6] ..... H05B 6/30; H05B 6/32

[52] U.S. Cl. ..... 373/139; 219/648; 219/672

[58] Field of Search ..... 373/138, 139, 373/146, 166; 219/648, 673, 675, 604; 310/90.5; 361/144; 164/503

[56] References Cited

U.S. PATENT DOCUMENTS

| | | | |
|---|---|---|---|
| 2,686,864 | 8/1954 | Wroughton et al. | 373/138 |
| 2,722,589 | 11/1955 | Marquardt | 219/648 |
| 4,110,586 | 8/1978 | Kohl et al. | 219/648 |
| 4,414,285 | 11/1983 | Lowry et al. | 428/577 |
| 4,539,456 | 9/1985 | Mohr | 219/648 |
| 4,678,024 | 7/1987 | Hull et al. | 164/503 |
| 4,738,713 | 4/1988 | Stickle et al. | 75/10.18 |
| 4,761,579 | 8/1988 | Delassus | 310/90.5 |
| 4,874,346 | 10/1989 | Wachspress | 446/484 |
| 4,979,182 | 12/1990 | Lohoefer | 373/138 |
| 5,150,272 | 9/1992 | Danley et al. | 361/144 |
| 5,155,651 | 10/1992 | Yoda et al. | 361/144 |
| 5,319,670 | 6/1994 | Fox | 373/138 |
| 5,341,867 | 8/1994 | Yamada et al. | 164/502 |

OTHER PUBLICATIONS

Sergio R. Sagardia and R.S. Segsworth; Electromagnetic Levitation Melting of Large Conduction Loads; IEEE Transactions on Industry Applications, Jan./Feb. 1977; (pp. 49–52).

Yildiz Bayazitoglu and Udaya B. Sathuvalli; Eddy Current Heating in an Electrically Conducting Sphere; Journal of Materials Processing & Manufacturing Science; vol. 3, No. 2, Oct. 1994 (pp. 117–141(.

A. P. Vutsens; Physical Simulation Studies of Levitation of Liquid Metal Above Parallel Busses; 1974 Consultants Bureau, A division of Plenum Publishing Corp.; (pp. 304–307).

Professor Yildiz Bayazitoglu; Thermal Science Problems in 'Non–Contact' Materials Processing ; First International Thermal Energy Congress Proceedings—vol. 1; ITEC–93–6–10 Jun. 1993 (pp. 55–59).

*Primary Examiner*—Tu Ba Hoang

*Attorney, Agent, or Firm*—Conley, Rose & Tayon,P.C.

[57] ABSTRACT

An electromagnetic levitator is disclosed, comprising: a plurality of longitudinal sections formed from a conducting material and arranged around a longitudinal axis. The longitudinal sections are connected to a power source such that when the levitator is in operation, current flowing through adjacent longitudinal sections creates opposing magnetic fields. The levitator has first and second ends defining a levitation zone therebetween. When alternating current is passed through the conductors, a levitation tunnel is formed in the levitation zone, with the levitation tunnel having zero magnetic flux density along its center and non-zero magnetic flux density at all other points.

24 Claims, 9 Drawing Sheets

Levitation Coil Cross Section

LONGITUDINAL ELECTROMAGNETIC LEVITATOR

TECHNICAL FIELD OF THE INVENTION

The present invention relates to a device for containing and melting a material without contacting the molten material and more particularly relates to an electromagnetic levitation melting device. Still more particularly, the present invention relates to a conducting coil wound into a hollow shape such that the electromagnetic forces resulting from passage of current through the coil are zero at the center of the shape and increase rapidly to a maximum just inside the perimeter of the shape.

BACKGROUND OF THE INVENTION

In response to the growing need to handle high temperature reactive metals and alloys in today's manufacturing industry, various non-contact materials processing techniques have been developed. For example, a typical maximum temperature in a gas turbine may be on the order of 2000° F. The alloys developed for use at these temperatures all melt at extremely high temperatures. New alloys that are under investigation have melting points approaching and exceeding that of high temperature refractory ceramics, making them difficult to melt, cast, and forge. For instance, the tungsten and molybdenum alloys have melting points above the softening points of the highest temperature refractories. Using a conventional crucible to contain and melt these alloys would result in contamination of the specimen by material from the crucible itself.

One solution to this problem is to leave a layer, called a skull, of solid metal between the crucible and the metal being melted. In addition, vacuum melting is commonly used in high temperature applications to melt higher percentages of reactive metals, improve mechanical properties (including fatigue strength, ductility, and impact strength), decrease scatter in the mechanical properties, and improve the billet to bar stock conversion ratio in wrought alloys.

A non-contact casting process would allow melting and casting of even the highest melting temperature metals without contamination from the crucible and without needing a skull layer to separate the molten metal and the crucible. In this manner, levitation casting would also allow a bar of alloy to be zone-refined. In zone refining, a slice, or zone, of the bar is melted, and this molten zone is moved along the length of the bar. Impurities are trapped in the molten zone, and eventually concentrated at one end of the bar, which is then removed. The zone refining process can be repeated on a single specimen to yield ultra-pure metals, and is commonly used in the semiconductor industry to purify silicon crystals. Non-contact levitation of the molten zone during this process would allow the molten zone to be contained without contamination from the container.

One non-contact levitation technique uses alternating currents in a coiled conductor to create time-varying magnetic fields that can be used to contain nonmagnetic conducting materials. With respect of their magnetic properties, materials may be grouped into three categories: ferromagnetic, paramagnetic, and diamagnetic. Ferromagnetic materials can support long range ordering of their magnetic moments, and thus have a relative permeability much greater than one. Relative permeability is a measure of the ease with which magnetic fields can be established in a material, as compared to vacuum. Permeability is the magnetic analog of electrical conductivity; high conductivity material passes electricity readily, high permeability aterial passes magnetic fields readily. Paramagnetic materials have a relative permeability on the order of 1.00001, arising from the magnetic dipole moment of their spinning electrons. Diamagnetic materials have a relative permeability of 0.99999, arising mainly from the orbital motion of the electrons within their atoms.

Materials with a relative permeability greater than one will experience a force oriented so as to increase the magnetic field within the material when exposed to static or dynamic magnetic fields. Materials that produce their own magnetic field will also experience a force orienting their field parallel to the external field. Materials with a relative permeability less than one will experience forces oriented so as to reduce the magnetic field strength within the material. For all practical purposes, both paramagnetic and diamagnetic materials may be assumed to have a relative permeability of one. i.e.; they are not affected by static magnetic fields. Some ferromagnetic materials, such as iron, change their relative permeability with temperature. Above a certain temperature, referred to as the curie point, iron becomes non-magnetic. This state can also be produced at room temperature by the addition of certain alloying elements, as in the 300 series of stainless steels.

In addition, dynamic magnetic fields and/or moving materials will induce eddy currents in conductive materials that act to reduce the magnetic field in the material. The eddy currents produce ohmic heating in the material, and are acted upon by the magnetic field, producing a force on the conducting material called the Lorentz force. These forces are related to the gradient (change in magnitude versus change in position: slope) of the magnetic field and are directed from areas of high gradient to areas of low gradient. Under certain conditions, the Lorentz forces and heating can be relatively controlled so as to produce levitation and/or melting of a conducting body. Electromagnetic levitation melting is known in the art and various levitators have been designed for the purpose of containing and levitating solid and molten metal."

One such levitator is disclosed in *Electromagnetic Levitation Melting of Large Conduction Loads,* Sagardia et al., IEEE Transactions on Industry Applications, vol. 1A-13, No. 1, January/February 1977. The Sagardia levitator has a vertical axis and contains the specimen in a generally bowl-shaped field. In order to prevent the liquid (molten) sample from leaking out through the bottom of the levitator, Sagardia uses multiple coils wound around different axes and operating at different frequencies. Sagardia's method produces a high rate of heating relative to the levitation force.

Other levitators use one or more helical coils wound into a generally conical or concave shape with the axis of the helix vertical carrying current of a single frequency. These single frequency levitators all have an area on the bottom of the levitated specimen where the levitation force is zero. At this point, all that opposes the downward pressure of the molten metal is surface tension. This pressure depends on the height of the specimen which, in combination with the shape produced by the eddy currents elsewhere, is also related to the volume of the specimen. When the height of molten metal exceeds a critical value, it leaks out of the force-free region. Given a generally top-shaped specimen, this leakage places a severe restriction on the mass of metal that can be levitated by this method. Other disadvantages of known levitators include: lack of control over specimen position within the levitator, limitations on the shape of the specimen, and lack of visual or physical access to the specimen."

U.S. Pat. No. 4,414,285 discloses a non-contact vessel for containing a stream of molten metal. The device requires a flow of molten metal under pressure up into the lower end of the vessel and a cooling zone adjacent the upper end of the vessel for receiving the cast metal. The '285 device works by applying an upward force to metal in the non-contact zone, thereby eliminating hydrostatic head from the portion of metal immediately below it and allowing the pressurized metal to flow up into the non-contact zone. The non-contact zone provides an upward force by operation of a plurality of circumferential coils, each operating 60 degrees out of phase with its neighbors, forming a linear polyphase motor. When alternating current is passed though the '285 device, it forms a traveling magnetic field inside the coils. This traveling field pulls the molten metal upwards, acting in a fashion similar to that of the rotating field in a normal polyphase motor. The '285 device requires the use of a "starting rod" that is joined in the initial stage of the process to the liquid metal column for the purpose of lifting the metal column into the device to initiate feed. The '285 device also requires an external cooling medium.

It is desired to provide an electromagnetic levitator in which the specimen heating associated with the application of a given levitation force is minimized. As heat can always be supplied by an external source, such as a second coil, minimization of specimen heating by the levitator allows separation of heating and levitation and therefore allows greater control over the process. The heat generated in a specimen per time and volume unit is proportional to the magnetic flux density, while the force exerted on a specimen per volume unit is proportional to the gradient of the magnetic flux density. Thus, the objective of minimizing heating while maximizing levitation may be met by providing an electromagnetic levitator that includes an operating area wherein the magnetic flux density is relatively small but subject to a steep gradient.

It is a further object of this invention to provide a levitator that is capable of levitating a specimen having a mass greater than the mass of specimens levitatable by previously known levitators. It is a still further object of this invention to provide a levitator that allows the specimen to be easily viewed and/or manipulated during levitation and maintains the specimen in a stable levitation zone. Other objects and advantages of the invention will appear from the following description.

SUMMARY OF THE INVENTION

The present invention comprises a substantially horizontal levitator capable of suspending sizable specimens and capable of operating in either continuous or batch mode. The present levitator comprises a generally cylindrical levitation zone formed by positioning a plurality of conductors longitudinally about an axis and passing alternating current in opposite directions through adjacent pairs of conductors. The levitator is preferable formed by bending a single length of conductor into a plurality of longitudinal straight sections. In this manner, when current is passed through the conductor, a tunnel-shaped levitation zone having an opening at each end is formed. Specimens can be placed in the levitation zone individually or fed into the levitation zone through one end and removed therefrom through the opposite end. It is also possible to access the levitation zone through the side of the levitator. The present levitator provides a strong levitation force with minimal heating in the specimen. The present levitator can levitate even large specimens indefinitely without causing melting and/or boiling of the specimen.

BRIEF DESCRIPTION OF THE DRAWINGS

For a detailed description of a preferred embodiment of the invention reference will now be made to the accompanying drawings wherein.

DETAILED DESCRIPTION OF THE INVENTION

Figure 1:
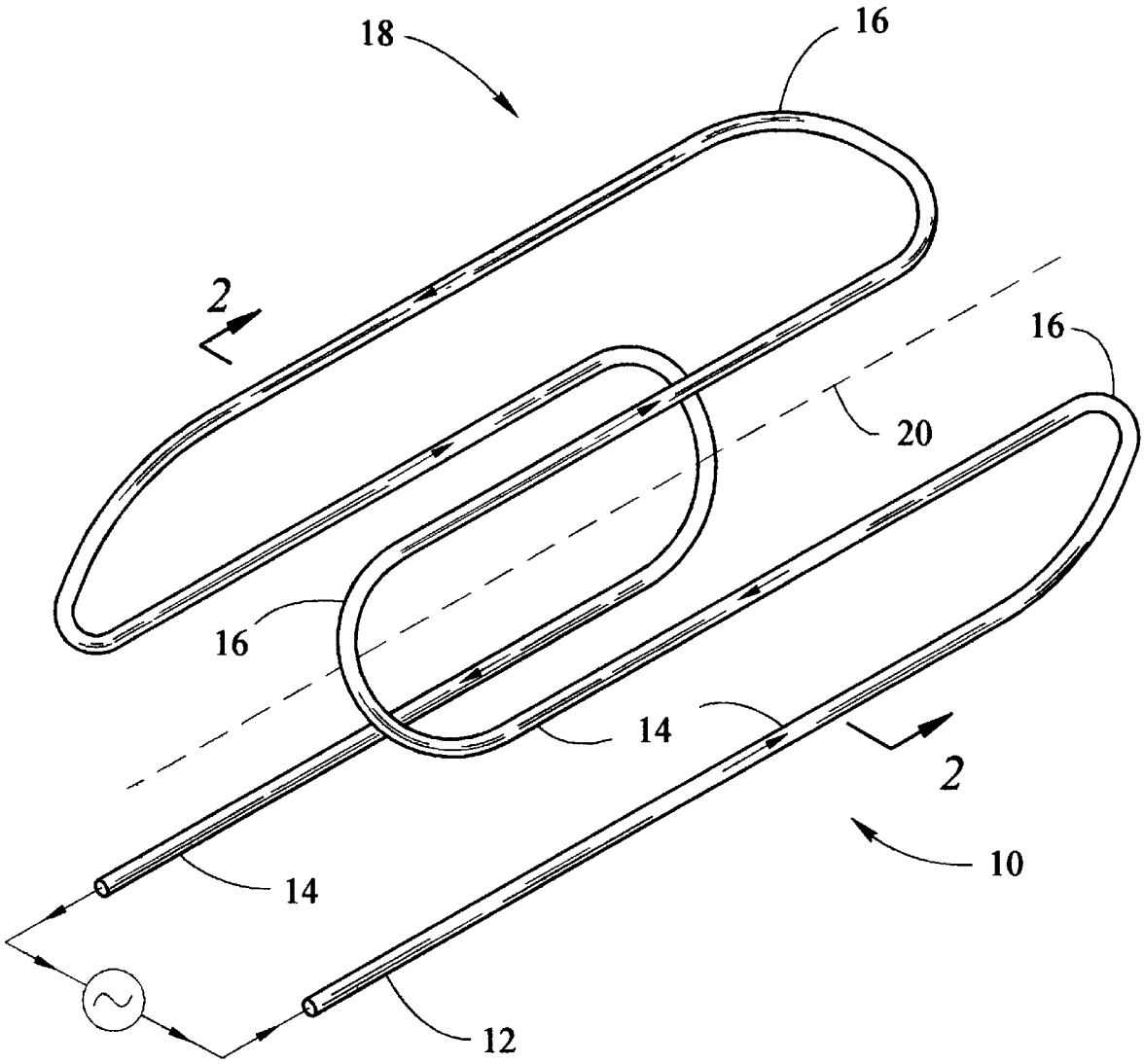
FIG. 1 is an isometric view of a preferred embodiment of the present levitator.

Referring initially to FIG. 1, a preferred levitator 10 can be formed according to the present invention by bending a length of copper tubing 12 so that it forms a plurality of longitudinal straight sections 14, which are joined by a plurality of connecting bends 16. According to the embodiment shown in FIG. 1, there are six straight sections 14 and five bends 16. Straight sections 14 and bends 16 define a cylinder 18 around an axis 20. Because there are an even number of straight sections 14 and an odd number of bends 16, the two ends 23, 24 of tubing 12 are adjacent each other and are at the same end of cylinder 18. Although it is not necessary to position the tubing ends 23, 24 at the same end of the cylinder in this manner, doing so greatly facilitates the connection of the levitation coil to the power supply. Alternatively, the loops of coil 10 could be constructed so that some, or all, conductors carrying current in the same direction were connected in parallel, rather than being connected in series. Further, the conductors could be constructed so that some, or all, of them may be supplied from sources differing in phase and/or frequency.

Coil 10 can be made of any conductor, preferably of low resistance, that is capable of withstanding the operating current of the levitator. The present coils are preferably made of 3/16 inch diameter copper tubing, through which cooling water is passed. The cooling water is provided to prevent coil 10 itself from overheating and has little effect on the temperature of the specimen. In the alternative, coil 10 can be made of conducting wire, instead of tubing, and the cooling medium, if any, can be supplied to coil 10 externally.

Figure 2:
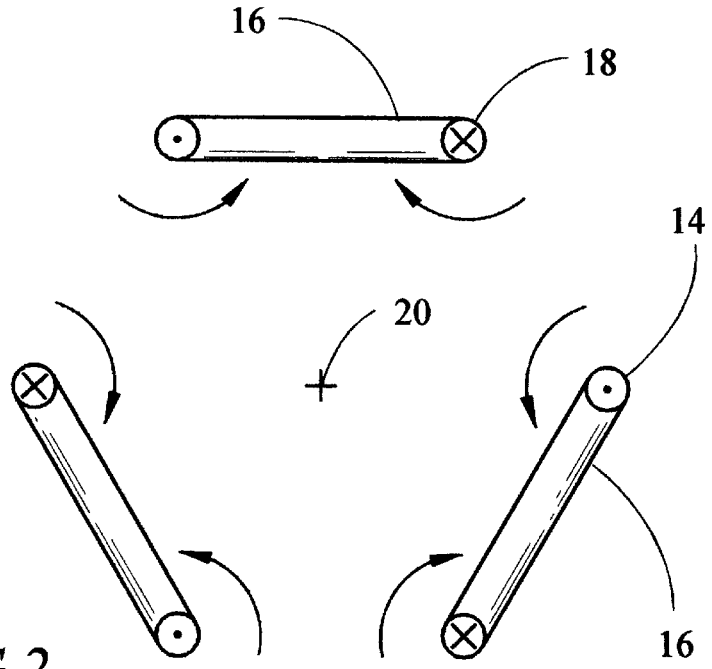
FIG. 2 is a cross-sectional view taken along line 2—2 in FIG. 1 and showing the direction of current flow and the magnetic field lines associated therewith.
Figure 2A:
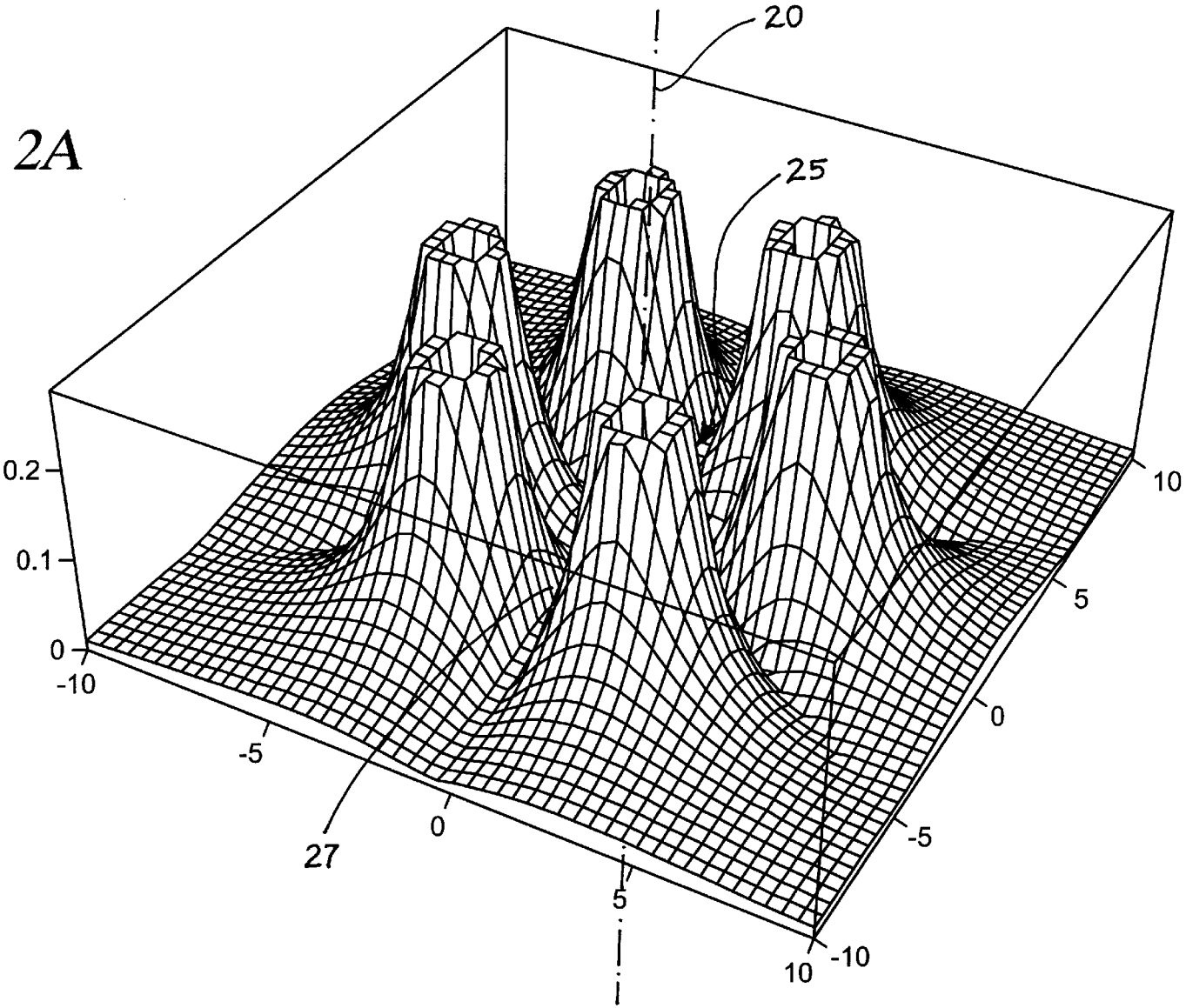
FIG. 2A is a schematic representation of the magnetic flux density in the cross-sectional plane shown in FIG. 2.

Referring now to FIGS. 2 and 2A, the current in adjacent straight sections 14 flows in opposite directions, forming three pairs of opposed magnetic poles. This means that the magnetic fields produced by flowing current through each straight section 14 are also opposed. For purposes of illustration, the magnetic flux density at various points in a cross-sectional plane through the levitator at an instant in time is shown as elevation in FIG. 2A. As can be seen, the levitator creates a range of magnetic flux density values having a zero value around the axis of the levitator and outside of it, and reaching maxima and mimima on the surface of the conductors. The points of zero value at the center of each peak are where the conductors are located, as there is no magnetic flux inside the conductors. The absolute magnitude of the magnetic field is shown as elevation in FIG. 2A. The magnitude and direction of the force on a conducting specimen within the present levitation coil are related to the slope of this graph. A useful analogy is to imagine placing a marble on this surface. The marble will experience forces analogous to those experienced by the specimen. It will tend to settle to the axis of the coil, and if an external force is applied in by tilting the entire surface, the marble will move to a position part way up the slopes between two conductors. If the tilt is large enough, it will balance between the two conductors (if it is small enough to get there) and finally fall out of the coil. The levitation coils embodied in the present work have two types of stable regions; on axis, and between conductors. The region, or well, 25 centered on axis 20 is stable, having a restoring force in all directions. The points 27 situated midway between each pair of adjacent conductors are metastable; that is, they have restoring forces pushing away from the conductors, but no net forces directed radially either into or out of the coil.

Figure 2B:
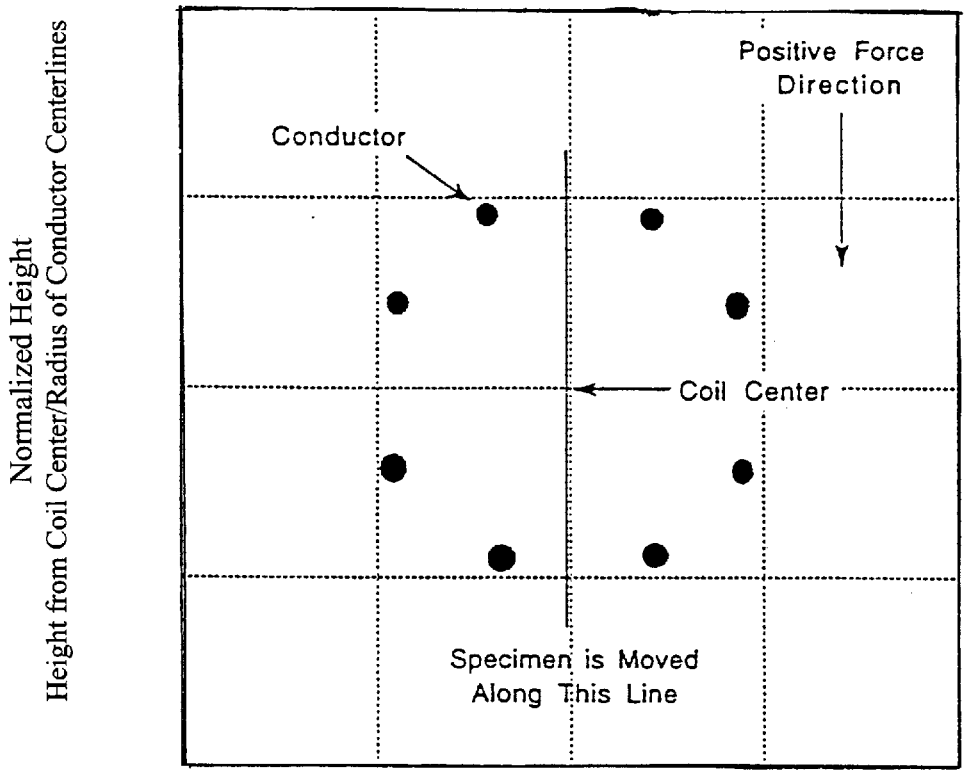
FIG. 2B is a schematic representation of the coil cross section shown in FIG. 2, with the direction of specimen movement and force measurement indicated thereon.
Figure 2C:
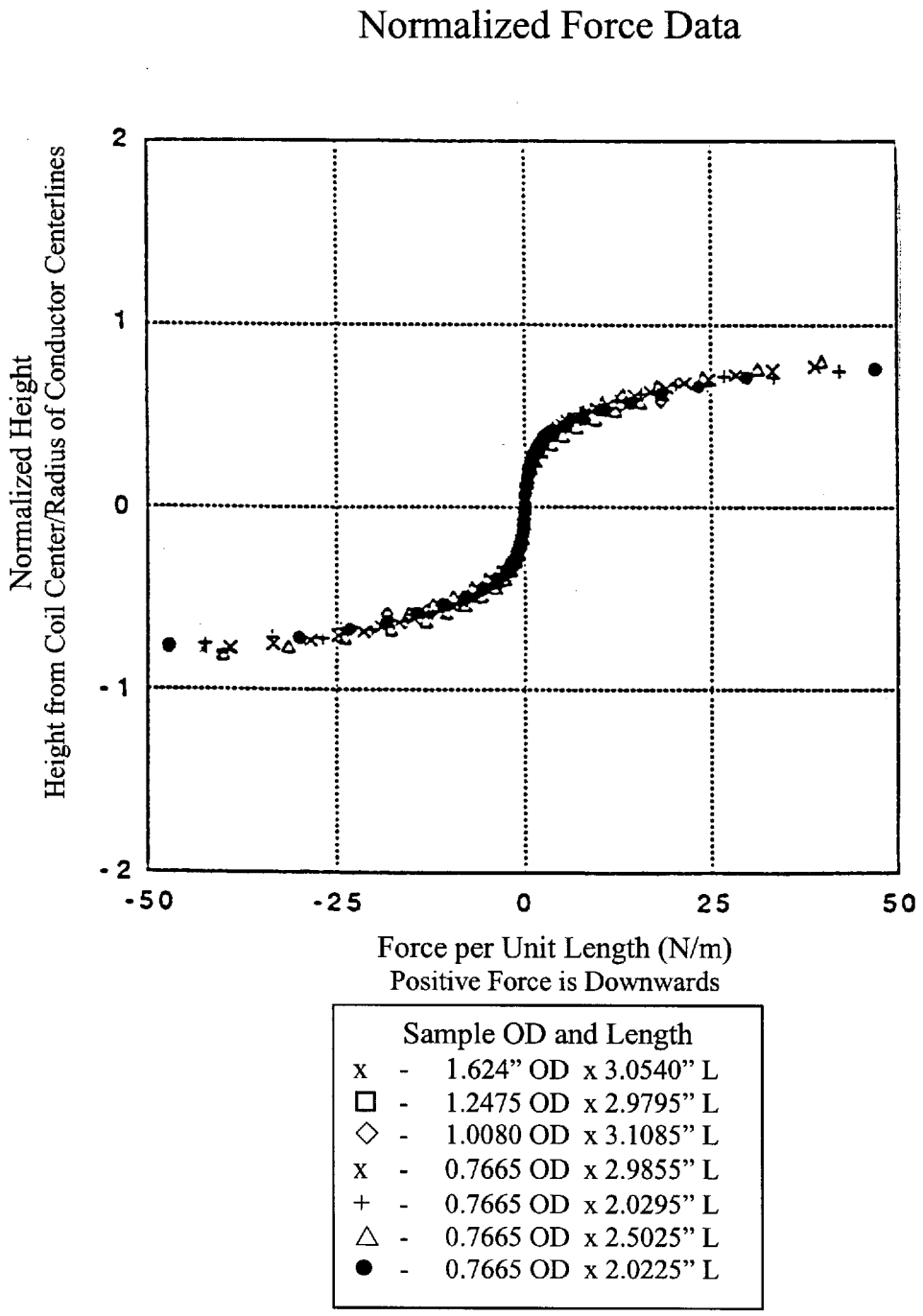
FIG. 2C is a plot of the normalized force data for a specimen moving along the line indicated in FIG. 2B.

A conductive specimen placed on the axis of this levitator and subjected to an external force, such as gravity, will move toward the perimeter of the levitator until the gradient of the magnetic flux density at that point is great enough to balance the external force. The specimens position will be stable at this point and the specimen will return to this point if slightly dislodged. In the absence of gravity or other external force, therefore, the specimen's most stable position is along the axis 20 of the levitator. Referring briefly to FIGS. 2B and 2C, a plot of experimental data illustrates the foregoing. FIG. 2B includes a diagram of the poles centered on a coordinate system. The data in FIGS. 2C and 2D comprise measurements taken as each specimen was moved along line 28 of FIG. 2B. Thus, the exponential increase in force that is seen in FIG. 2B as the specimen approaches the perimeter of the levitator corresponds to the exponential peaks shown in FIG. 2A.

When operated in the presence of gravity, the levitator of FIG. 1 is preferably operated with its axis 20 horizontal. Thus, the region of low magnetic flux gradient located on and immediately around axis 20 of levitator 10 and represented as the well in FIG. 2A forms a levitation "tunnel" having a length similar to the length of the levitator. Specimens may be freely moved along the length of this tunnel by tilting the levitator or by applying a small external force along the axis of the levitator. By making the levitator axis wavy rather than straight, a series of stable positions or pools within the levitator can be created. Slight adjustments to the angle of the levitator or the application of external forces (such as those supplied by a second coil operating at a different frequency) can move specimens along or amongst these well(s) under close control. By using multiple phases, it is also possible to cause the specimen to rotate under control. Both rotary and translational motion within the levitator experience no frictional effects, permitting extremely high velocities.

The present levitator has one or more lines of zero force lying on the perimeter of the cylindrical coil and parallel to the axis of the levitator, similar to the point of zero force at the center of conventional levitators. These zero force lines may be eliminated by using multiple frequencies or multiple phases, allowing additional height in the specimen, without departing from the spirit of the present invention.

Even without eliminating the zero force lines, the present levitator is able to vastly exceed the lifting capacity of conventional levitators by increasing the volume of the specimen without increasing its height. The configuration of the present levitator results in a region of exponentially increasing restoring force, from which a specimen would have to escape before it could "fall" out of the levitator. The volume increase made possible by the present levitator is a result of the increased area available for the application of levitating force to the specimen. The mass or volume that can be levitated by the present levitator depends directly on the length of the levitator and/or the width of the levitator. Wider levitators must, according to the present invention, have sufficient multiple conductors under the specimen to maintain it within the levitator.

Figure 2D:
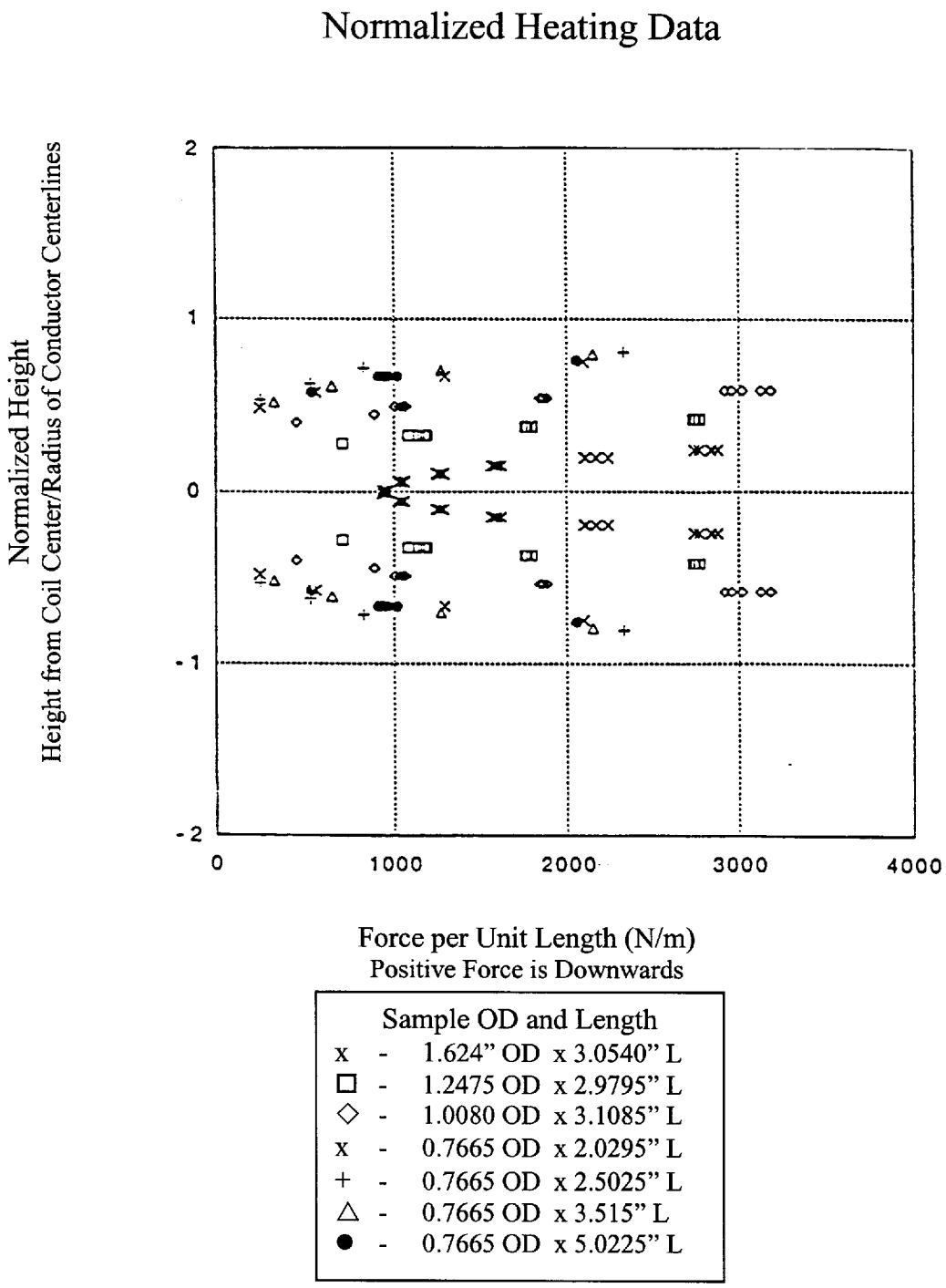
FIG. 2D is a plot of the normalized heating data for a specimen moving along the line indicated in FIG. 2B.

Because of the large area of low magnetic flux density within this levitator, it produces less heating in levitated specimens than other types of levitators, allowing control of the temperature of the specimen using the heat produced by the levitator or by the application of external heat. FIG. 2D shows experimental measurements of the heating rates produced in specimens of various diameters and lengths at points within a coil. As a specimen is moved away from the axis of the levitator, the heat produced in it increases. Referring to FIG. 2D, it can be seen that, as each specimen is moved vertically away from the center of the levitator, the amount of heating measured in the specimen increases. Comparison of the data of FIG. 2D with that set out in FIG. 2C illustrates the correlation between force and heating experience by a given specimen as it moves within the levitator.

The specimen temperature is dependent on: 1) the rate of induction heating in the specimen, 2) the rate of heat loss to the surrounding atmosphere, if any, and 3) the rate of heat provided by the external heat source, if any. Because so little heat is transferred to the specimen by the present levitator, it is less likely that the specimen will be molten in the absence of an external heat source. Even when the specimen is molten in the absence of an external heat source, as in the case of low-melting metals, the rate of induction heating is so low that the specimen can be easily maintained below its melting point by misting it with an air/water spray mist or similar cooling medium.

A molten specimen in the present levitator is repulsed by the field surrounding each pole 14. In the absence of gravity, the molten specimen is shaped only by the magnetic flux density and its own surface tension and therefore assumes a slightly star-shaped or lobed cross-section. In the presence of gravity, the cross-section of the specimen is somewhat flattened, as the top poles of the levitator play a less important role in containing the specimen. The cross sectional shape of the specimen can be modified by changing the spacing and configuration of the poles. Hence, it is possible to produce near net shape specimens of arbitrary shape requiring less machining than the generally pear shaped specimens produces by prior levitators.

Figure 4:
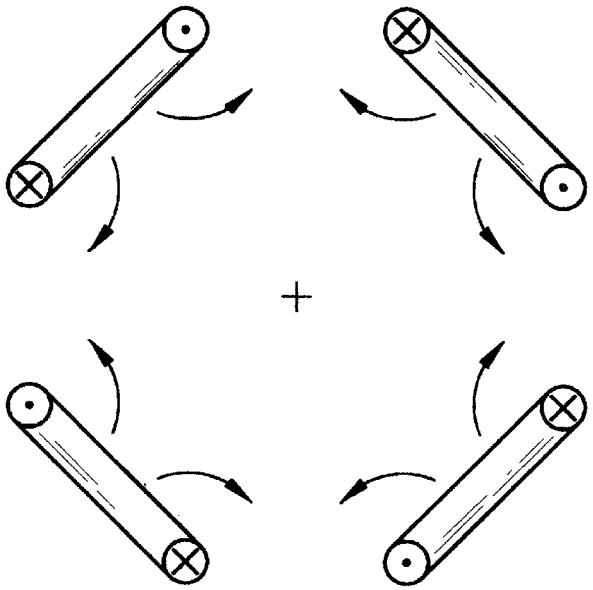
FIG. 4 is a cross-sectional view taken along line 4—4 in FIG. 3 and showing the direction of current flow and the magnetic field lines associated therewith.
Figure 3:
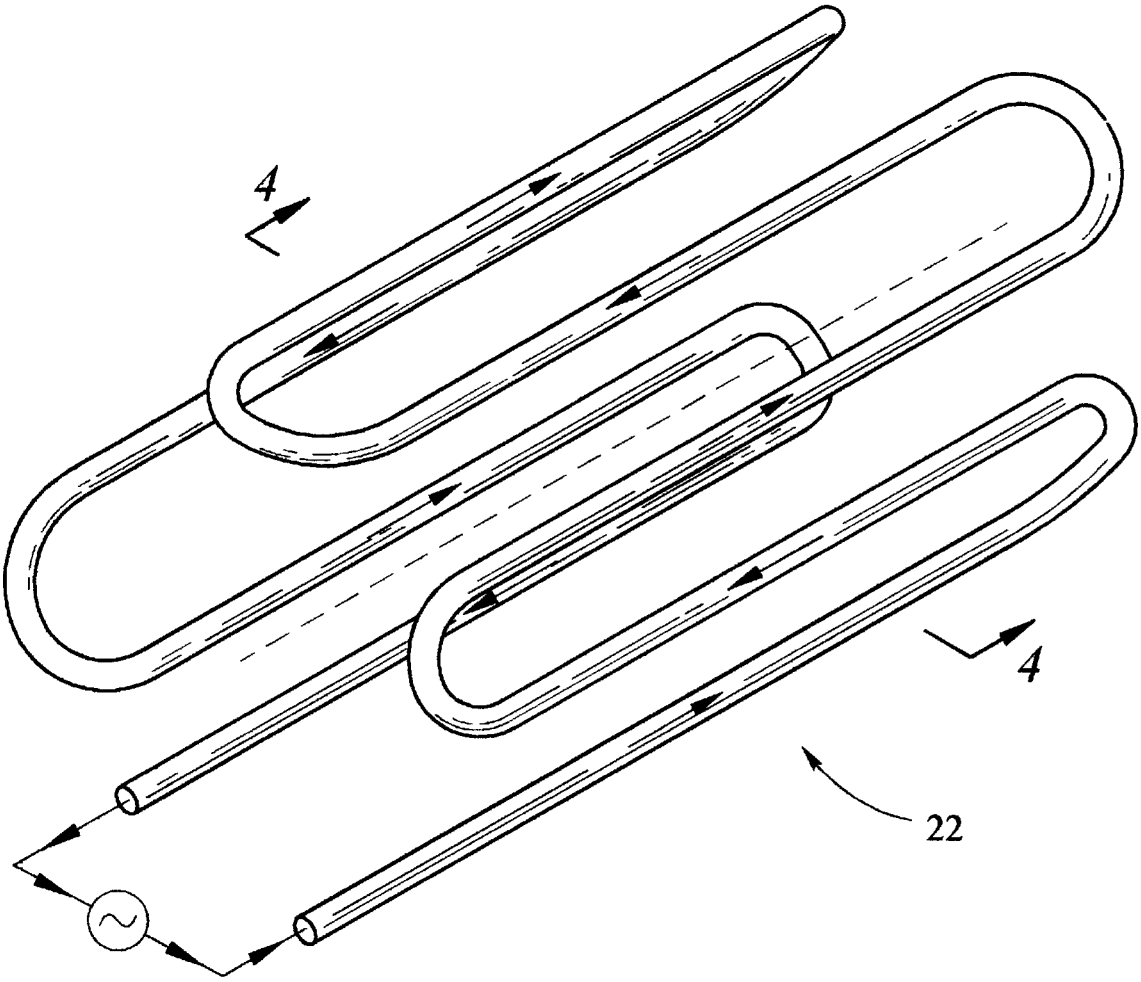
FIG. 3 is an isometric view of a first alternative embodiment of the present levitator.

Referring now to FIGS. 3 and 4, the present levitator can also be configured in an embodiment having eight, instead of six poles to form an eight-pole levitator 22. This results in a slightly more even distribution of the repulsive forces around the specimen, but also increases inductance in the levitator coil. The number of poles can be decreased or increased further, but it has been found that the optimal number of poles is 3 to 20, more preferably 4 to 12, and most preferably 6 to 10.

Figure 5:
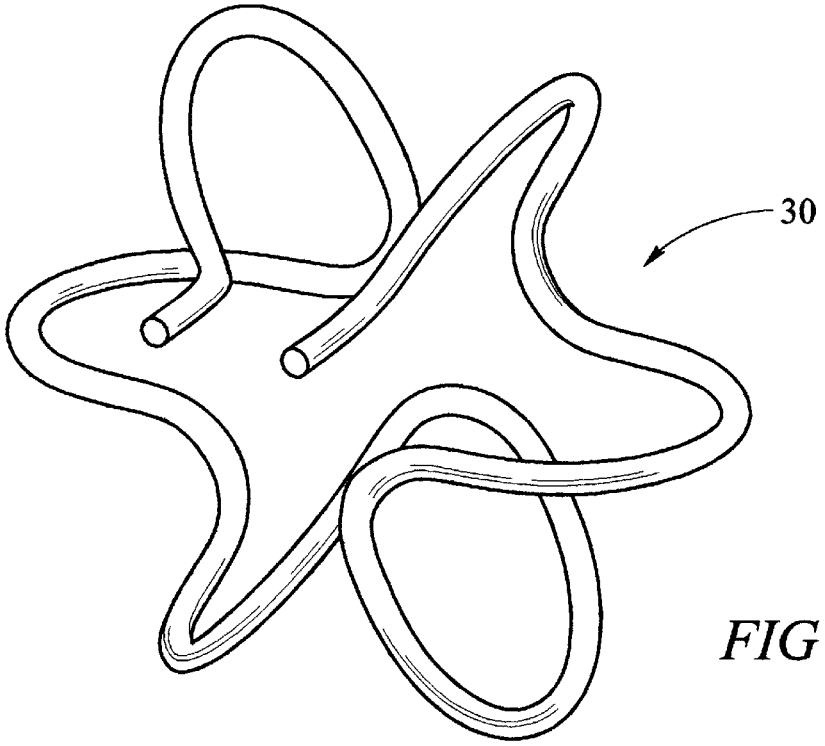
FIG. 5 is a perspective view of a second alternative, spherical embodiment of the levitator of the present invention.
Figure 6:
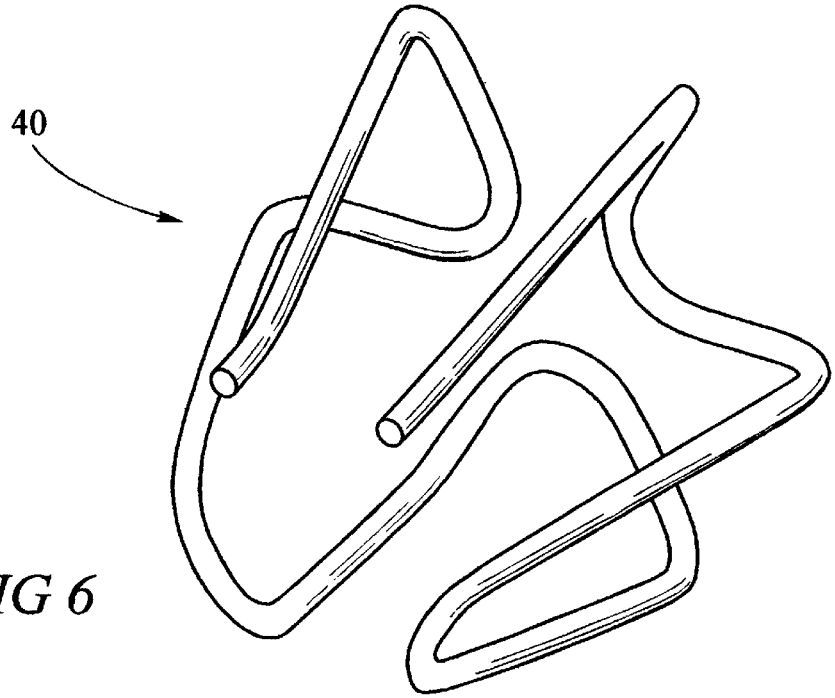
FIG. 6 is a perspective view of a third alternative, conical embodiment of the levitator of the present invention.
Figure 7:
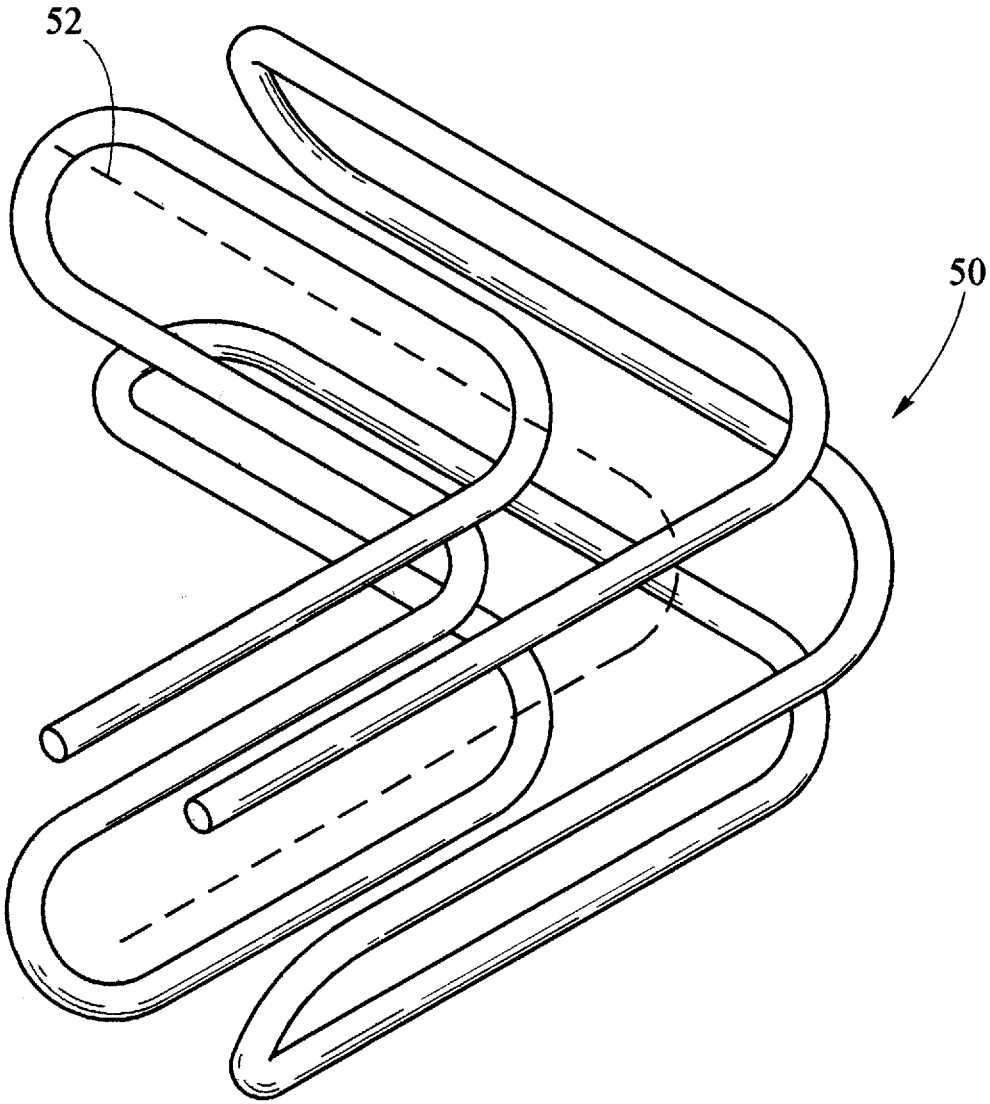
FIG. 7 is a perspective view of a third alternative, non-linear embodiment of the levitator of the present invention.

In addition to varying the number of poles in a cylindrical levitator, the present invention can be configured to define various other shapes, as shown in FIGS. 5 through 7. In each instance, the lengths of tubing between the reversing bends are parallel to and surround the axis of the desired shape. It will be noted that the lengths of tubing between the bends need not be straight. In FIG. 5, each length of tubing has been bowed outward and the length of the levitator 30 is decreased, so that the electromagnetic forces define a spherically shaped region of low flux. The levitator 40 shown in FIG. 6 forms a conical specimen in the absence of gravity. Levitators such as 30 and 40 can be used to mold a specimen into a desired shape, so that less machining is required. The levitator 50 of FIG. 7 closely resembles that of FIGS. 1 and 3, but its longitudinal axis axis 52 is not straight. As in levitator 10, a tunnel of low magnetic flux is defined along axis 52, so the levitator of FIG. 7 can be used to produce a specimen that is not straight. The foregoing embodiments are intended to be illustrative only, and are not exhaustive of the possible shapes that could be cast using variations of the levitator shown in FIG. 1. For example, the present device can be used to cast near net shape pieces of reactive metals to be used as turbine blades.

The present levitator is also useful for levitating magnetic specimens. When placed in the magnetic field of the present levitator, a magnetic specimen does not immediately levitate. Instead, it rests on the coil and is subjected to rapid inductance heating. Once it reaches its curie point, it becomes non-magnetic and levitates. Once levitated, it may continue heating until it melts.

If it is desired to melt a levitated specimen, it is preferred in most instances that the atmosphere surrounding the specimen be such that oxidation of the molten specimen does not occur. This can be achieved by evacuating the processing environment or by providing a processing atmosphere that is either inert or reducing. Contamination of the specimen is further avoided by using inert tools, such as ceramic push rods, to manipulate the specimen and any materials that are to be added to the specimen. By adding dips along the length of the levitator, multiple specimens can be levitated, moved, and mixed under control using either coil tilt, or external forces such as a second coil operating at a different frequency. By using multiple phases, it is also possible to cause the specimen to rotate under control. Material flow within a molten specimen is rapid, so the present levitator can produce effective mixing of multiple molten specimens when such specimens are placed in contact with each other while levitating.

The present levitator can be used in either batch or continuous mode. In batch mode, individual specimens or groups of specimens are separately processed in the levitator and the levitator is emptied between batches. If power to the levitator is off when a batch is placed in the device, the specimen or specimens comprising the batch will rest on the lower coils and must be large enough to be mechanically supported by the coils. If the levitator is already turned on when the specimen is placed inside it, the specimen will levitate immediately. When the levitator is operated continuously, new material is fed into the levitation zone and processed material is removed from the levitation zone continuously. Unlike prior art levitators, levitators according to the present invention are particularly well suited to processing in the continuous mode because they provide unobstructed access to the levitation zone at each end of the levitation "tunnel." Material can be fed into one end of the levitator, moved through the levitation zone along its axis, and be removed at the opposite end of the levitation zone. Alternatively, because the amount of heat imparted to the specimen by the present levitator is so small, the specimen can be suspended its solid state and an external heat source can be used to cause localized heating of the specimen. The molten region can be moved along the specimen by moving the heat source, or the specimen itself can be moved relative to the heat source. If desired, changes to the shape of the specimen can be made at the molten region so that they are reflected in the cast solid when the specimen is cooled. Any necessary manipulations of the specimen are preferably performed by manipulation of the coil itself or by other non-contact methods, or using ceramic tools or tools constructed of other inert material.

In addition to the foregoing, it is possible to further manipulate the specimen by manipulating and/or rotating the levitator itself. For example, a substantially cylindrical levitator having a slightly curved axis can be used to levitate and melt two specimens. With the center of the curved levitator uppermost, the specimens are maintained apart in the two zones of lowest potential energy. Once the specimens are melted, the levitator is rotated 180° so that the center of the levitator is lowermost and the two molten specimens flow together into a single zone. Alternatively, because the specimen is maintained in a stable position within the levitator, the specimen can easily be maneuvered by moving the levitator itself.

By way of example only, the following Table I provides an indication of three specimens and the volume of each that has been levitated with the present invention.

TABLE 1

| Material | Mass (g) | Force per Unit Length (N/m) |
|---|---|---|
| Copper, 1" O.D., solid | 622 | 400 |
| Aluminum 1" O.D., solid | 302 | 133 |
| Aluminum 1", O.D., solid | 180 | 116 |

While a preferred embodiment of the invention has been shown and described, modifications thereof can be made by one skilled in the art without departing from the spirit of the invention.

What is claimed is:

1. An electromagnetic levitator, comprising:

a plurality of longitudinal sections formed from a conducting material and arranged around a longitudinal axis, said longitudinal sections being connected to at least one power sources such that when the levitator is in operation, current flowing through adjacent longitudinal sections creates opposing magnetic fields;

wherein a specimen placed on said longitudinal axis exhibits no net current flow through a cross section taken normal to said axis when current flows through said sections.

2. The levitator according to claim 1 wherein there are six longitudinal sections.

3. The levitator according to claim 1 wherein there are eight longitudinal sections.

4. The levitator according to claim 1 wherein said longitudinal sections comprise a plurality of conductors connected in parallel.

5. The levitator according to claim 1 wherein said longitudinal sections are formed from a single piece of conducting material.

6. The levitator according to claim 4 wherein said conducting material comprises copper.

7. The levitator according to claim 5 wherein said conducting material comprises copper tubing through which a cooling medium is passed.

8. The levitator according to claim 1 wherein said longitudinal sections define a circular cylinder around said longitudinal axis, said longitudinal sections being equidistant from said longitudinal axis and said cylinder having an axis coincident with said longitudinal axis, and wherein the levitator is configured and sized to levitate at least 622 grams of copper.

9. The levitator according to claim 1 wherein the levitator is configured and sized to apply at least 400 N/m of levitating force to a copper specimen in an ambient environment without melting said specimen.

10. An electromagnetic levitator comprising a plurality of conductors configured so as to define a levitation zone having a longitudinal axis and a length along said axis, said conductors being substantially parallel to said axis along said length of said zone wherein a specimen placed in said levitation zone exhibits no net current flow through a cross section taken normal to said axis when current flows through said conductors.

11. The levitator according to claim 10 wherein said axis is horizontal.

12. The levitator according to claim 10 wherein said conductors define a circular cylinder said longitudinal sections being equidistant from said longitudinal axis and said cylinder having an axis coincident with said longitudinal axis.

13. The levitator according to claim 12 wherein said cylinder is a bent cylinder.

14. The levitator according to claim 10 wherein said levitation zone is substantially conical.

15. The levitator according to claim 10 wherein said levitation zone is substantially spherical.

16. The levitator according to claim 10 wherein said conductors are substantially parallel to each other along said length of said zone.

17. An electromagnetic levitator having first and second ends and a levitation zone therebetween, said levitator comprising a plurality of conductors arranged such that when alternating current is passed through said conductors a levitation tunnel is formed in said levitation zone, wherein said levitation tunnel has a centerline and wherein a magnetic field resulting from passage of said current through said conductors has zero magnetic flux density along a said centerline and non-zero magnetic flux density at all other points and wherein a specimen placed in said levitation zone exhibits no net current flow through a cross section taken normal to said axis when current flows through said conductors.

18. The levitator according to claim 17 wherein access to said levitation tunnel is through said first and second ends.

19. The levitator according to claim 18 wherein said levitation tunnel is horizontal.

20. A method for casting a metal specimen, comprising the steps of:

inserting the specimen into a horizontal levitation zone wherein the specimen is supported without the application of mechanical force and wherein the specimen exhibits no net current flow through a cross section taken normal to the levitation zone;

melting the specimen to form a molten specimen; and removing the specimen from said levitation zone.

21. The method according to claim 20 wherein said steps are carried out in continuous mode.

22. The method according to claim 20 wherein said steps are carried out in batch mode.

23. The method according to claim 20, further including the step of adding material to said molten specimen.

24. The method according to claim 20, further including the step of solidifying the specimen prior to removing the specimen from the levitation zone.

* * * * *